United States Patent [19]

Aoki et al.

[11] Patent Number: 4,892,810

[45] Date of Patent: Jan. 9, 1990

[54] SILVER HALIDE COLOR PHOTOGRAPHIC LIGHT-SENSITIVE MATERIAL CONTAINING CYAN DYE FORMING COUPLER

[75] Inventors: Kozo Aoki; Michio Ono; Naoki Saito, all of Kanagawa, Japan

[73] Assignee: Fuji Photo Film Co., Ltd., Kanagawa, Japan

[21] Appl. No.: 136,518

[22] Filed: Dec. 22, 1987

Related U.S. Application Data

[63] Continuation of Ser. No. 9,065, Jan. 27, 1987, abandoned, which is a continuation of Ser. No. 748,537, Jun. 25, 1985, abandoned.

[30] Foreign Application Priority Data

Jun. 25, 1984 [JP] Japan ..... 59-130745

[51] Int. Cl.[4] ..... G03C 7/34

[52] U.S. Cl. ..... 430/553; 430/552

[58] Field of Search ..... 430/552, 553

[56] References Cited

U.S. PATENT DOCUMENTS

| | | | |
|---|---|---|---|
| 3,998,642 | 12/1976 | Lau et al. | 430/553 |
| 4,239,851 | 12/1980 | Aoki et al. | 430/553 |
| 4,537,857 | 8/1985 | Takada et al. | 430/553 |
| 4,552,836 | 11/1985 | Tanabe et al. | 430/553 |
| 4,564,590 | 1/1986 | Sasaki et al. | 430/552 |
| 4,581,324 | 4/1986 | Wolff et al. | 430/505 |
| 4,731,320 | 3/1988 | Sasaki et al. | 430/552 |

FOREIGN PATENT DOCUMENTS

| | | |
|---|---|---|
| 0112514 | 7/1984 | European Pat. Off. . |
| 0156377 | 2/1985 | European Pat. Off. . |
| 0163314 | 4/1985 | European Pat. Off. . |
| 0142086 | 5/1985 | European Pat. Off. . |
| 0156363 | 9/1985 | European Pat. Off. . |
| 0161577 | 11/1985 | European Pat. Off. . |
| 0164030 | 11/1985 | European Pat. Off. . |
| 0183444 | 4/1986 | European Pat. Off. . |
| 3517396 | 11/1985 | Fed. Rep. of Germany . |
| 1325363 | 8/1973 | United Kingdom . |

OTHER PUBLICATIONS

Japanese Patent Abstract, vol. 10, No. 157 (p. 464), Jun. 6, 1986; JP-A-619652.

Japanese Patent Abstract, vol. 10, No. 278 (p. 499), Sep. 20, 1986; JP-A-6199141—Pub. May 17, 1986.

*Primary Examiner*—Richard L. Schilling

*Attorney, Agent, or Firm*—Sughrue, Mion, Zinn, Macpeak & Seas

[57] ABSTRACT

A silver halide color photographic light-sensitive material is described, the light-sensitive material containing a cyan dye forming coupler represented by the following general formula (I):

(I)

wherein $R_1$ represents an alkyl group having 2 to 15 carbon atoms, $R_2$ and $R_3$ represent each a hydrogen atom or an alkyl group, $R_4$ represents a substituted aryl group which is substituted by a group other than an aryl group or an aralkyl group, X represents a hydrogen atom, a halogen atom, an alkyl group or an alkoxy group, Z represents a hydrogen atom or a group capable of release by an oxidation coupling reaction with the developing agent, n represents an integer of 1 to 4, and the total number of carbon atoms in the alkyl groups contained in $R_1$, $R_2$, $R_3$, $R_4$, X and Z is 8 or more, and the total number of carbon atoms in the alkyl groups substituted in $R_1$ and $R_4$, in the case that n is 1, is 11 or less.

11 Claims, No Drawings

SILVER HALIDE COLOR PHOTOGRAPHIC LIGHT-SENSITIVE MATERIAL CONTAINING CYAN DYE FORMING COUPLER

This is a continuation of application Ser. No. 07/009,065 filed Jan. 27, 1987, now abandoned, which is a continuation of application Ser. No. 06/748,537 filed June 25, 1985, now abandoned.

FIELD OF THE INVENTION

The present invention relates to silver halide color photographic light-sensitive materials containing a novel cyan dye forming coupler.

BACKGROUND OF THE INVENTION

After a silver halide photographic light-sensitive material is exposed to light, it is subjected to color development processing, whereby an aromatic primary amine developing agent oxidized by silver halide reacts with dye forming couplers to form a color image.

Generally, in this process, color reproduction by a subtractive process is frequently used. In order to reproduce blue, green and red colors, yellow, magenta and cyan color images which are complement colors, respectively, are formed.

As the cyan color image forming couplers, phenols or naphthols are often used. However, there are some problems in preservation stability of color images obtained from the phenols and naphthols heretofore used. For example, color images obtained from 2-acylaminophenol cyan couplers described in U.S. Pat. Nos. 2,367,531, 2,369,929, 2,423,730 and 2,801,171 are generally inferior in fastness to heat. Color images obtained from 2,5-diacylaminophenol cyan couplers described in U.S. Pat. Nos. 2,772,162 and 2,895,826 are generally inferior in fastness to light, and 1-hydroxy-2-naphthamide cyan couplers are generally insufficient in fastness to both light and heat (particularly, wet heating).

On the other hand, phenol couples described in U.S. Pat. Nos.3,772,002 have fairly improved fastness to heat, but they are insufficient in preservation for a long period of time including fastness to light, and they have a fault in that the cyan density is greatly reduced in case of using a fatigued bleach-fix solution.

SUMMARY OF THE INVENTION

An object of the present invention is to provide silver halide color photographic light-sensitive materials containing a cyan dye forming coupler in which the above described drawbacks are overcome.

The object of the present invention has been attained by using couplers represented by the following general formula (I).

General formula (I)

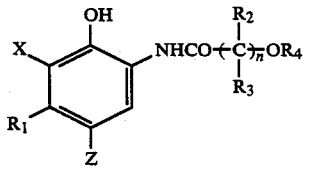

(wherein $R_1$ represents an alkyl group having 2 to 15 carbon atoms, $R_2$ and $R_3$ represent each a hydrogen atom or an alkyl group, $R_4$ represents a substituted aryl group (excluding aryl substituted groups and aralkyl substituted groups), X represents a hydrogen atom, a halogen atom, an alkyl group or an alkoxy group, Z represents a hydrogen atom or a group capable of releasing by an oxidation coupling reaction with the developing agent, n represents an integer of 1 to 4, and the total number of carbon atom in the alkyl groups contained in $R_1$–$R_4$, X and Z is 8 or more, and the total number of carbon atoms in the alkyl groups substituted in $R_1$ and $R_4$, in the case that n is 1, is 11 or less).

DETAILED DESCRIPTION OF THE INVENTION

In the following, $R_1$, $R_2$, $R_3$, $R_4$, X and Z in the general formula (I) are described in detail.

In general formula (I), $R_1$ represents an alkyl group having 2 to 15 carbon atoms preferably 2 to 6 carbon atoms (for example, an ethyl group, butyl group, tert-butyl group, cyclohexyl group or pentadecyl group).

In general formula (I), $R_2$ and $R_3$ each represents a hydrogen atom or an alkyl group having 1 to 21 carbon atoms preferably 1 to 12 carbon atoms (for example, a methyl group, isopropyl group or dodecyl group).

In general formula (I), $R_4$ represents an aryl group (for example, a phenyl group or naphthyl group), and this aryl group has substituents selected from alkyl groups, heterocyclic groups, alkoxy groups (for example, methoxy group, 2-methoxyethoxy group, etc.), aryloxy groups (for example, 2,4-di-tert-amylphenoxy group, 2-chlorophenoxy group, 4-cyanophenoxy group, etc.), alkenyloxy groups (for example, 2-propenyloxy group, etc.), acyl groups (for example, acetyl group, benzoyl group, etc.), ester groups (for example, butoxycarbonyl group, phenoxycarbonyl group, acetoxy group, benzoyloxy group, butoxysulfonyl group, toluenesulfonyloxy group, etc.), amido groups (for example, acetylamino group, ethylcarbamoyl group, dimethylcarbamoyl group, methanesulfonamide group, butylsulfamoyl group, etc.), sulfamide groups (for example, dipropylsulfamoylamino group, etc.), imido groups (for example, succinimido group, hydantoinyl group, etc.), ureido groups (for example, phenylureido group, dimethylureido group, etc.), aliphatic or aromatic sulfonyl groups (for example, methanesulfonyl group, phenylsulfonyl group, etc.), aliphatic or aromatic thio groups (for example, ethylthio group, phenylthio group, etc.), hydroxyl group, cyano group, carboxyl group, nitro group, sulfo group, halogen atoms and so forth. However, substitution by aryl groups and aralkyl groups is excluded.

In general formula (I), X represents a hydrogen atom, a halogen atom (for example, a fluorine atom, chlorine atom or bromide atom), an alkyl group having 1 to 20 carbon atoms preferably 1 to 6 carbon atoms (for example, a methyl group, tert-butyl group, cyclohexyl group or sec-octadecyl group) or an alkoxy group (for example, methoxy group or butoxy group).

In general formula (I), Z represents a hydrogen atom or a coupling releasing group, examples of which include halogen atoms (for example, fluorine atom, chlorine atom, bromine atom, etc.), alkoxy groups (for example, ethoxy group, dodecyloxy group, methoxyethylcarbamoylmethoxy group, carboxypropyloxy group, methylsulfonylethoxy group, etc.), aryloxy groups (for example, 4-chlorophenoxy group, 4-methoxyphenoxy group, 4-carboxyphenoxy group, etc.), acyloxy groups (for example, acetoxy group, tetradecanoyloxy group, benzoyloxy group, etc.), sulfonyloxy groups (for example, methanesulfonyloxy group, toluenesulfonyloxy group, etc.), amido groups (for example, dichloroacetylamino group, heptafluorobutyrylamino group, methanesulfonylamino group, toluenesulfonylamino group, etc.), alkoxycarbonyloxy groups (for example, ethoxycarbonyloxy group, benzyloxycarbonyloxy group, etc.), aryloxycarbonyloxy groups (for example, phenoxycarbonyloxy group, etc.), aliphatic or aromatic thio groups (for example, ethylthio group, phenylthio group, tetrazolylthio group, etc.), imido groups (for example, succinimido group, hydantoinyl group, etc.), aromatic azo groups (for example, phenylazo group, etc.), etc. These releasing groups may have photographically useful groups.

In general formula (I), n represents an integer of 1 to 4.

In general formula (I), the total number of carbon atoms in the alkyl groups contained in $R_1$, $R_2$, $R_3$, $R_4$, X and Z is 8 or more in order to make the coupler molecule nondiffusible.

In general formula (I), the total number of carbon atoms in the alkyl groups substituted in $R_1$ and $R_4$, in the case that n is 1, is 11 or less.

In general formula (I), $R_1$ is preferred to be a chain, branched or cyclic alkyl group having 2 to 6 carbon atoms.

In general formula (I), desirably X is a hydrogen atom or a halogen atom, and, preferably, a chlorine atom or a fluorine atom.

In general formula (I), desirably Z is a hydrogen atom, a halogen atom or, an alkoxy group which may have substituents an aryloxy group or a sulfonamide group, and, preferably, a chlorine atom or a fluorine atom.

In the following, concrete compounds are exemplified, but the present invention is not restricted to them.

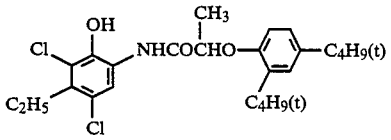
(1)

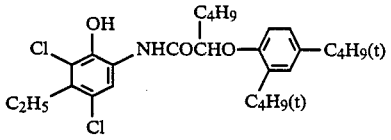
(2)

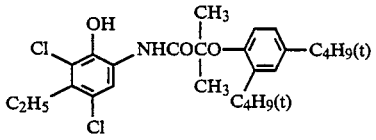
(3)

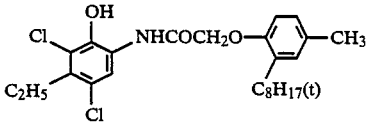
(4)

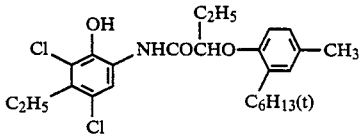
(5)

-continued

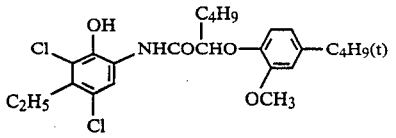
(6)

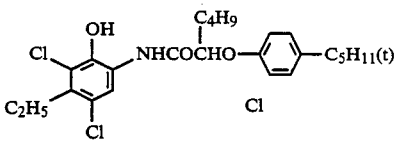
(7)

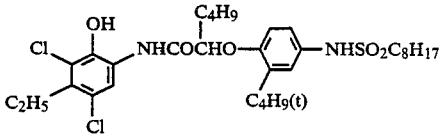
(8)

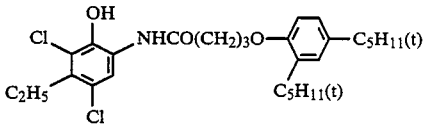
(9)

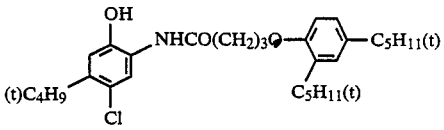
(10)

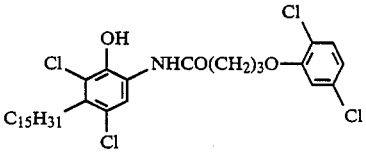
(11)

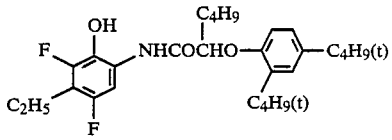
(12)

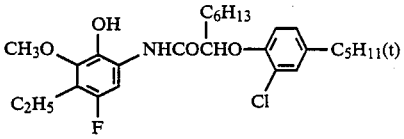
(13)

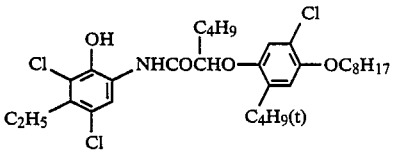
(14)

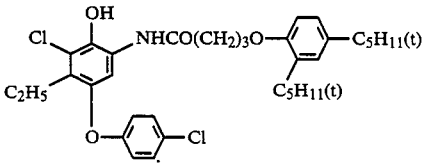
(15)

-continued (16)

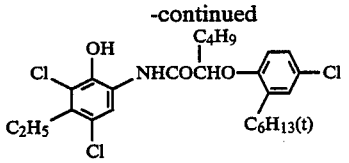

(17)

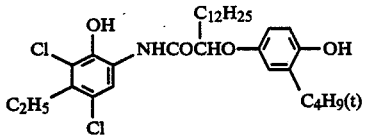

(18)

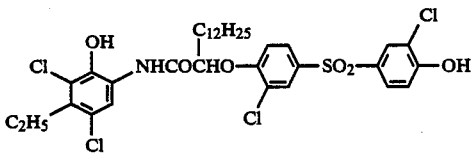

(19)

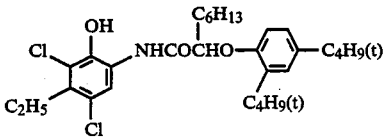

(20)

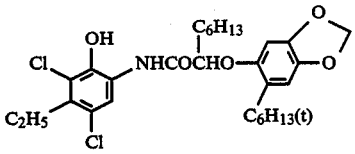

(21)

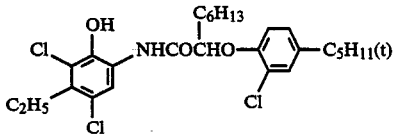

(22)

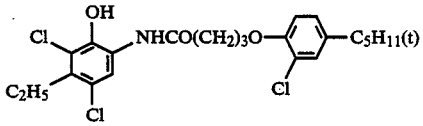

(23)

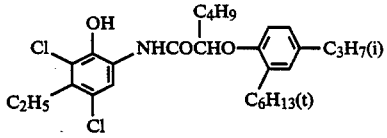

The amount of the coupler to be added in the present invention is in a range of $1\times10^{-3}$ mols to $7\times10^{-1}$ mols, preferably, $1\times10^{-2}$ mols to $5\times10^{-1}$ mols, per mol of silver in the emulsion layer.

The coupler of the present invention is synthesized by the processes described in U.S. Pat. No. 3,772,002. The coupler is preferably prepared, for example, by a reaction of 6-amino-3-alkylphenol derivative and a substituted aryloxy alkanoylhalide.

In the same or different photographic emulsion layer or an insensitive layer of the photographic light-sensitive materials produced according to the present invention, other dye forming couplers, namely, compounds which form color by oxidation coupling with an aromatic primary amine developing agent (for example, phenylenediamine derivatives, aminophenol derivatives, etc.) in the color development processing may be used together with the coupler represented by the above described general formula (I).

As couplers, typical examples of yellow couplers have been described in U.S. Pat. Nos. 2,875,057 2,407,210 3,265,506, 2,298,443, 3,048,194 and 3,447,928. Of these, yellow couplers, acylacetamide derivatives such as benzoylacetanilide or pivaloylacetanilide, etc., are preferred.

Accordingly, as yellow couplers, those represented by the following general formulae (A) and (B) are preferred.

(A)

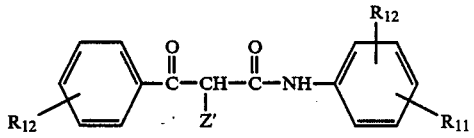

(B)

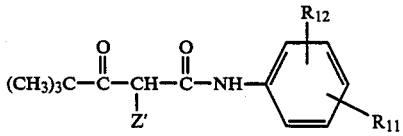

Z′ represents a group capable of release by a coupling reaction with an oxidation product of the developing agent (hereinafter, it has the same meaning till general formula (J)).

$R_{11}$ represents a nondiffusible group having a total of 8 to 32 carbons atoms preferably 12 to 32 carbon atoms, and $R_{12}$ represents a hydrogen atom, one or more halogen atoms, lower alkyl groups, lower alkoxy groups or nondiffusible groups having a total of 8 to 12 carbon atoms, preferably 8 to 22 carbon atoms. In the case that two or more of $R_{12}$ are present, they may be identical or may be different.

Typical examples of magenta couplers have been described in U.S. Pat. Nos. 2,600,788, 2,369,489, 2,343,703, 2,311,082, 3,152,896, 3,519,429, 3,062,653 and 2,908,573. In addition to them, as magenta couplers, arylthio group releasing pyrazolone type magenta couplers described in Japanese patent application (OPI) No. 35858/82 (the term "OPI" as used herein refers to a "published unexamined Japanese patent application") and Japanese patent application Nos. 110596/83 and 132134/83, and pyrazoloazole type magenta couplers such as 1H-imidazo(1,2-b)pyrazoles described in Japanese patent application No. 23434/83, 1H-pyrazolo(1,5-b)pyrazoles described in Research Disclosure 24230, 1H-pyrazolo(1,5-b)tetrazoles described in Research Disclosure 24220, 1H-pyrazolo(5,1-c)(1,2,4)triazoles described in Japanese patent application No 27411/72 or 1h-pyrazolo(1,5-b)(1,2,4)triazoles described in Japanese patent application No. 151354/83 can be desirably used in the present invention.

Accordingly, as magenta couplers, those represented by the following general formulae (C), (D) and (E) are preferred.

(C)

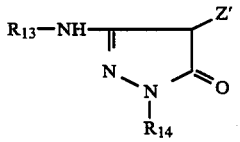

-continued (D)

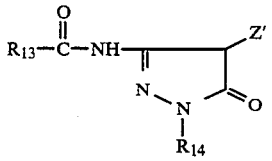

(E)

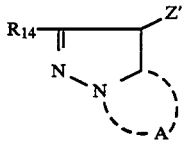

$R_{13}$ represents a nondiffusible group having a total of 8 to 32 carbon atoms preferably 12 to 32 carbon atoms, and $R_{14}$ represents one or more halogen atoms, a lower alkyl group, a lower alkoxy group, a phenyl group or a substituted phenyl group. A represents a non-metal atomic group necessary to form a 5-member azole ring containing 2 to 4 nitrogen atoms, wherein said azole ring may have substituents (including a condensed ring) and Z' is as described above.

Besides the cyan couplers of the present invention, other known cyan couplers can be used together with them. Typical examples of such cyan couplers have been described in U.S. Pat. Nos. 2,772,162 2,895,826, 3,002,836, 3,034,892, 2,474,293, 2,423,730, 2,367,531 and 3,041,236. Of these cyan couplers, phenols and naphthols are preferred.

Accordingly, as cyan couplers, those represented by the following formulae (F), (G), (H) and (J) are preferred.

(F)

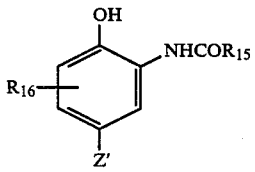

(G)

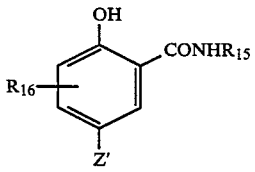

(H)

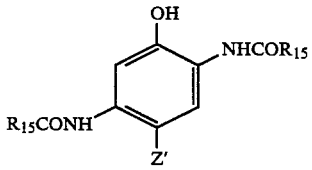

-continued (J)

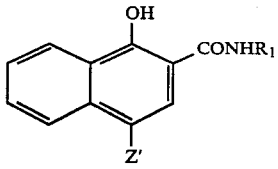

$R_{15}$ represents a substituent having 3 to 32 carbon atoms preferably 6 to 32 carbon atoms, which may have non-diffusibility, and $R_{16}$ represents one or more halogen atoms, a lower alkyl group, or a lower alkoxy group, and, in the case that two or more of $R_{15}$ or $R_{16}$ are present in the molecule, they may be identical or may be different, and Z' is defined as above.

Particularly desirable cyan couplers for use together with the cyan couplers of the present invention are 2,5-diacyl type cyan couplers belonging to the above described general formula (H). As examples of such compounds, there are those described in Japanese Patent Application Nos. 20432/83, 42671/83 and 133293/83.

Cyan couplers capable of desirable use together with the cyan couplers represented by the general formula (I) of the present invention are represented by the following general formula (II).

General formula (II)

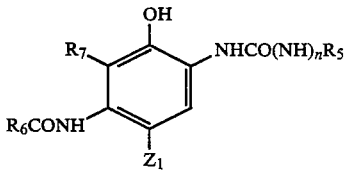

In the formula, $R_5$ and $R_6$ each represent an aliphatic group, an aryl group or a heterocyclic group, which is substituted or not substituted. $R_7$ represents a hydrogen atom, a halogen atom, an alkyl group or an acylamino group, and $R_7$ may represent a non-metal atomic group which forms a nitrogen containing 5 or 6 member ring together with $R_6$. $Z_1$ represents a hydrogen atom or a group capable of release by an oxidation coupling reaction with a developing agent. n is 0 or 1. The above described "aliphatic group" means any of saturated and unsaturated groups such as an alkyl, alkenyl or alkynyl group including any of straight chain, branched chain and cyclic groups.

In the following, desirable examples of cyan couplers represented by general formula (II) are shown.

(II-1)

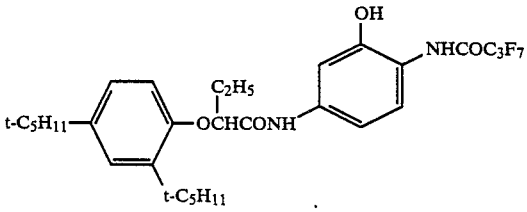

-continued
[II-2]
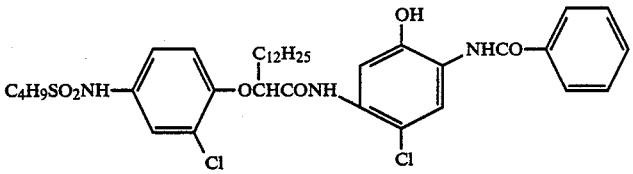
[II-3]
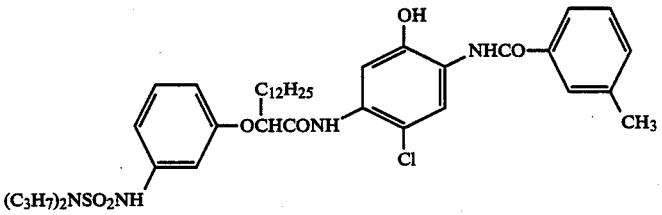
[II-4]
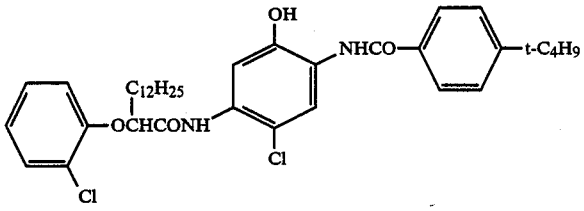
[II-5]
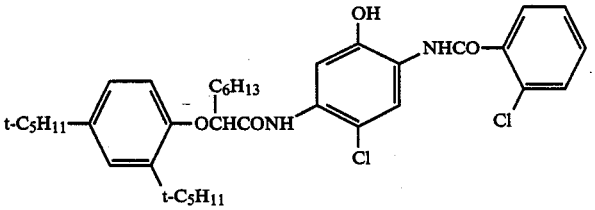
[II-6]
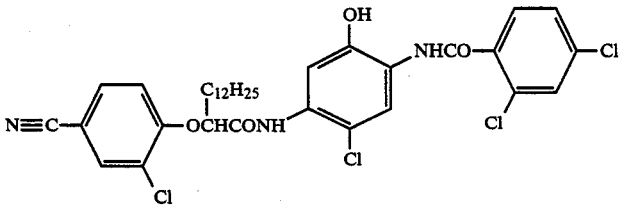
[II-7]
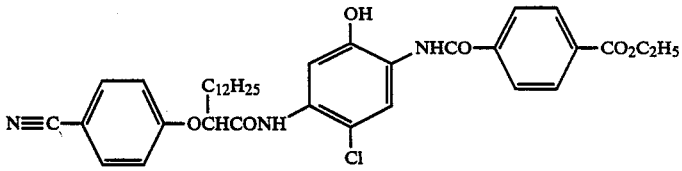
[II-8]
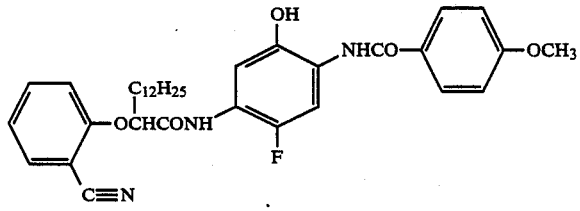

-continued
[II-9]
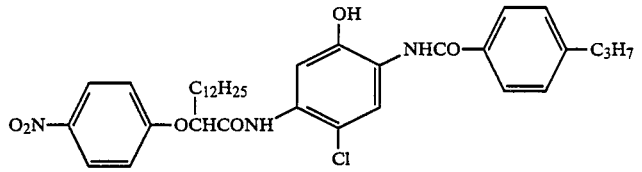
[II-10]
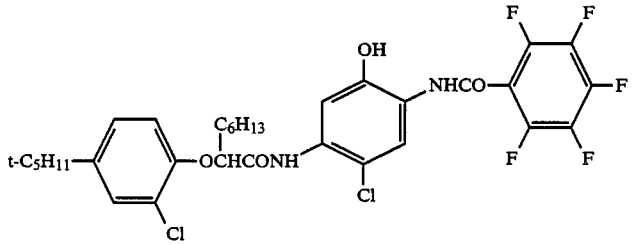
[II-11]
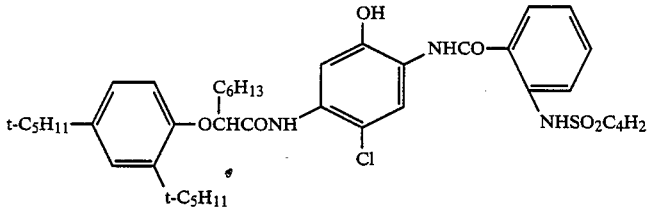
[II-12]
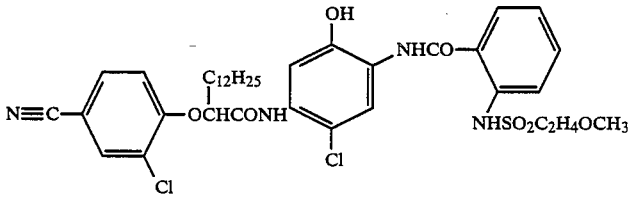
[II-13]
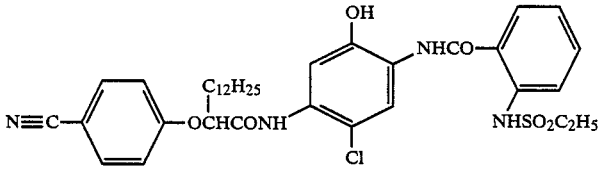
[II-14]
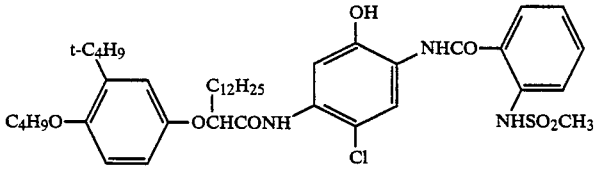
[II-15]
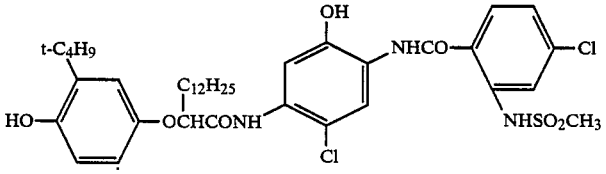

-continued
[II-16]
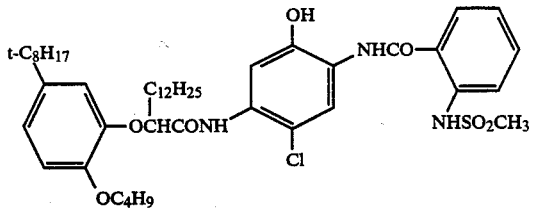
[II-17]
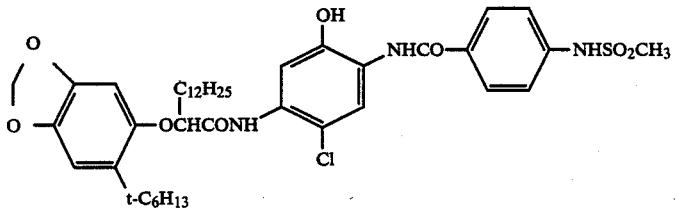
[II-18]
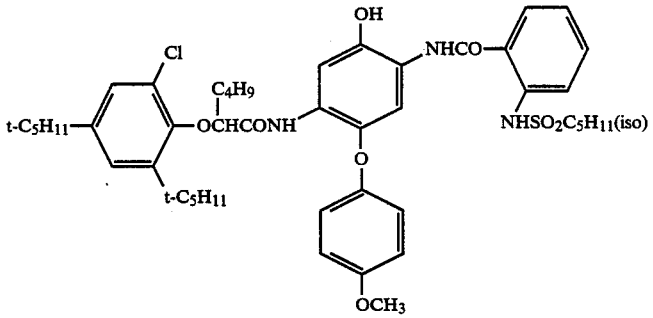
[II-19]
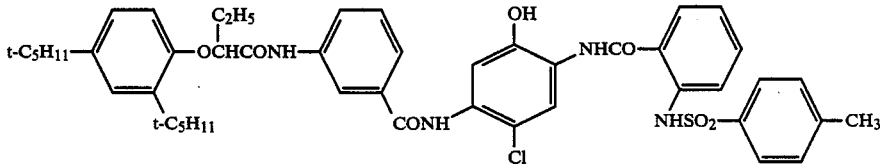
[II-20]
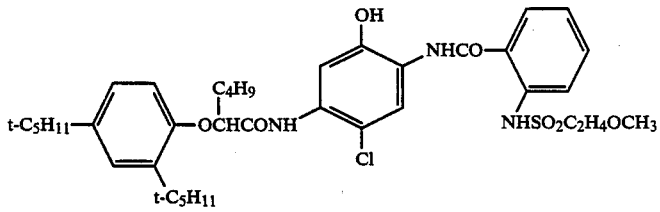
[II-21]
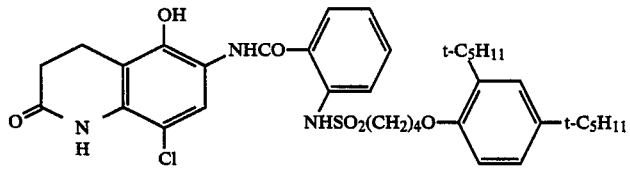
[II-22]
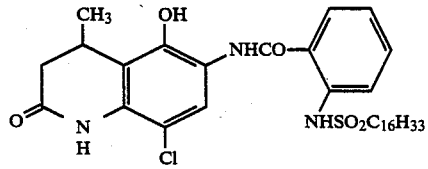

-continued
[II-23]
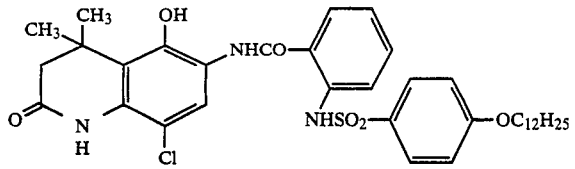
[II-24]
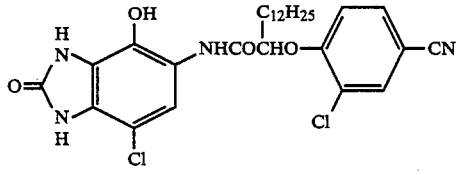
[II-25]
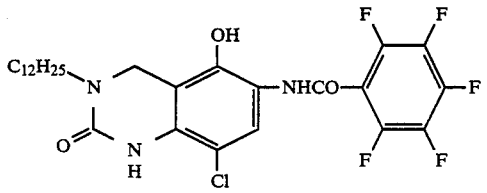
[II-26]
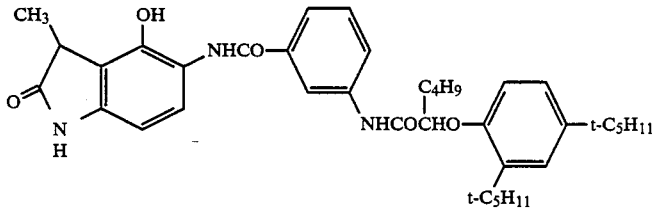
[II-27]
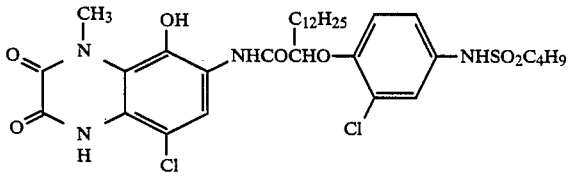
[II-28]
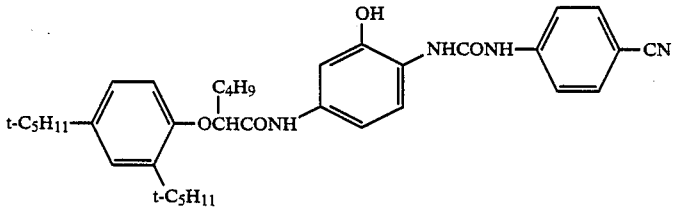
[II-29]
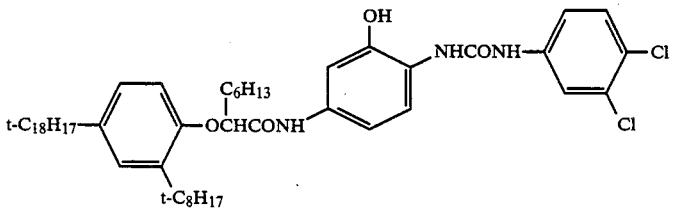

-continued

[II-30]

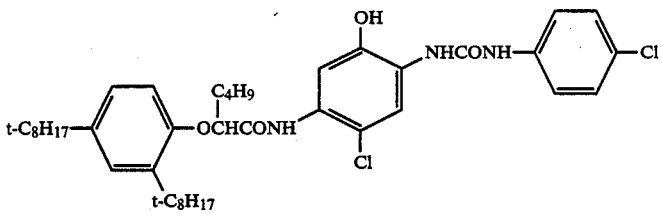

[II-31]

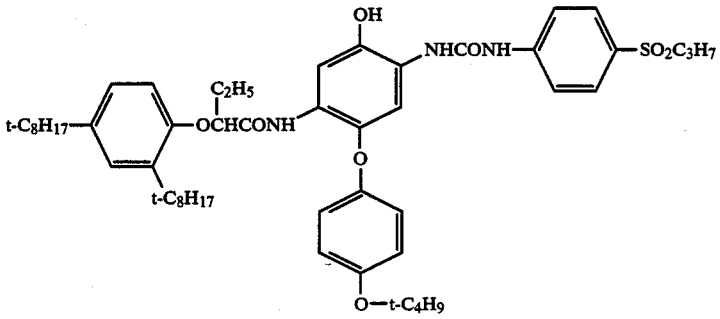

These couplers are preferred to be nondiffusible substances having a hydrophobic group called a ballast group in the molecule or can be polymerized substances. The couplers may be any of 4-equivalent type and 2-equivalent type to a silver ion. Further, they may be colored couplers having a color correction effect or couplers which release a development restrainer by development (the so-called DIR coupler).

In addition to DIR couplers, noncoloring DIR coupling compounds which form a colorless product by a coupling reaction and release a development restrainer may be employed. The light-sensitive materials may contain compounds which release a development restrainer by development other than the DIR couplers.

For the purpose of satisfying the characteristics required for the light-sensitive materials, two or more kinds of the couplers of the present invention and the above described couplers may be incorporated in the same layer, and it is of course possible to add one compound to two or more different layers.

The amount of cyan couplers used together with the cyan couplers represented by the general formula (I) of the present invention is about 5 to 250 mol% based on the cyan coupler of the present invention.

Yellow couplers, magenta couplers and cyan couplers are generally added to a blue-sensitive layer, a green-sensitive layer and a red-sensitive layer, respectively. However, they may be added to another different color sensitive layer or may be added to nonsensitive layers, according to the purpose.

In the present invention, in order to introduce the couplers into silver halide emulsion layers, known processes, for example, a process described in U.S. Pat. No. 2,322,027, etc., can be used. For example, they are dispersed in a hydrophilic colloid after they are dissolved in phthalic acid alkyl esters (dibutyl phthalate or dioctyl phthalate, etc.), phosphoric acid esters (diphenyl phosphate, triphenyl phosphate, tricresyl phosphate or dioctylbutyl phosphate), citric acid esters (for example, tributyl acetylcitrate), benzoic acid esters (for example, octyl benzoate), alkylamides (for example, diethyl laurylamide), aliphatic acid esters (for example, dibutoxyethyl succinate or diethyl azelate), trimesic acid esters (for example, tributyl trimesate), etc., or organic solvents having a boiling point of about 30° C. to 150° C., for example, lower alkyl acetates such as ethyl acetate or butyl acetate, ethyl propionate, secondary butyl alcohol, methyl isobutyl ketone, $\beta$-ethoxyethyl acetate, methyl cellosolve acetate, etc. The above described high boiling point solvents and low boiling point solvents may be used as a mixture thereof.

Further, a dispersion process using polymers described in Japanese Patent Publication No. 39853/76 and Japanese patent application (OPI) No. 59943/76 can be used.

In the case that the couplers have acid groups such as carboxylic acid or sulfonic acid groups, they are introduced into the hydrophilic colloid as an alkaline aqueous solution.

As a binder or a protective colloid capable of use for emulsion layers and intermediate layers in the light-sensitive materials of the present invention, gelatin is advantageously used. However, other hydrophilic colloids can be used alone or together with gelatin.

In the present invention, gelatin may be any of lime processed gelatin and acid processed gelatin. Details of the process for producing gelatin are described in Arthur Veis: The Macromolecular Chemistry of Gelatin (Academic Press, 1964).

In the photographic emulsion layers of the photographic light-sensitive materials used in the present invention, as a silver halide, any of silver bromide, silver iodobromide, silver iodochlorobromide, silver chlorobromide and silver chloride may be used. A desirable silver halide is silver iodobromide containing 15% by mol or less of silver iodide. A particularly desirable silver halide is silver iodobromide containing 2% by mol to 12% by mol of silver iodide.

The average particle size (diameter of the grains in the case of spherical or nearly spherical grains, or edge length in the case of cubic grains, which is presented as an average based on the projected area) of the silver halide grains in the photographic emulsions is not particularly limited. The silver halide grains may be fine grains having 0.1 $\mu$ or less, or rather large sized, grains having 5 $\mu$ or more, of a diameter in projected area, but the particle size is preferred to be 0.05 to 3 $\mu$.

The particle size distribution may be be either narrow or broad.

The silver halide grains in the photographic emulsions may have a regular crystal form such as a cube or octahedron, or may have an irregular crystal form such as a sphere or plate, or a mixed crystal form of them. Further, they may be composed of a mixture of grains in different crystal form.

Emulsions wherein superflat silver halide grains having a diameter of 5 times the thickness thereof are 50% or more of the whole projected area may be used.

In the silver halide grains, the inner part and the surface layer may have a different phases. Further, the grains may be those wherein a latent image is formed mainly on the surface thereof or may be those wherein a latent image is formed mainly in the inner part thereof.

The photographic emulsions used in the present invention can be prepared by processes described in P. Glafkides: Chimie et Physique Photographique (Paul Montel, 1967), G. F. Duffin: Photographic Emulsion Chemistry (The Focal Press, 1966), V. L. Zelikman et al: Making and Coating Photographic Emulsions (The Focal Press, 1964), etc. Namely, any of an acid process, a neutral process and an ammonia process may be used. As a manner of reacting soluble silver salts with soluble halide salts, any of one-side mixing, simultaneous mixing and a combination of them may be used.

A process for forming grains in the presence of excess silver ion (the so-called reverse-mixing process) can be used as well. As one type of the simultaneous mixing process, a process wherein the pAg in the liquid phase in which silver halide is formed is kept constant, namely, the so-called controlled double jet process, can also be used.

According to this process, silver halide emulsions having a regular crystal structure and nearly uniform particle size are obtained.

Two or more silver halide emulsions produced separately may also be mixed.

During the step of forming or physical ripening of the silver halide grains, cadmium salts, zinc salts, lead salts, thallium salts, iridium salts or complex salts thereof, rhodium salts or complex salts, thereof, iron salts or complex salts thereof, etc., may be allowed to coexist.

The silver halide emulsions are generally chemically sensitized. Chemical sensitization can be carried out by processes described in, for example, H, Frieser: "Die Grundlagender Photographischen Prozesse mit Silverhalogeniden" (Akademische Verlagsgesellschaft, 1968), pages 675 to 734.

Namely, a sulfur sensitization process using sulfur containing compounds capable of reacting with active gelatin or silver (for example, thiosulfates, thioureas, mercapto compounds, rhodanines), a reduction sensitization process using reducing substances (for example, stannous salts, amines, hydrazine derivatives, formamidine sulfinic acid, silane compounds) and a noble metal sensitization process using noble metal compounds (for example, complex salts of the group VIII metals such as Pt, Ir, Pd, etc., as well as gold complex salts) can be used alone or in combination.

In the photographic emulsions used in the present invention, various compounds can be incorporated for the purpose of preventing fog in the process of producing the light-sensitive materials, during preservation or during photographic processing or for the purpose of stabilizing photographic performances. Namely, it is possible to add many compounds known as antifoggants or stabilizers such as azoles, for example, benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly, 1-phenyl-5-mercaptotetrazole), etc.; mercaptopyrimidines; mercaptotriazines; thioketo compounds such as oxazolinethione; azaindenes, for example, triazaindenes, tetrazaindenes (particularly, 4-hydroxy substituted (1,3,3a,7)tetrazaindenes), pentazaindenes, etc.; benzenethiosulfonic acid, benzenesulfinic acid or benzenesulfonic acid amide.

Photographic emulsion layers or other hydrophilic colloid layers of the light-sensitive materials produced by the present invention may contain various surface active agents for various purposes such as, coating aid, prevention of static charge, improvement of slipping properties, emulsification and dispersion, prevention of adhesion and improvement of photographic properties (for example, acceleration of development, obtaining a hard tone, sensitization, etc.).

The photographic emulsion layers of the photographic light-sensitive materials of the present invention may contain polyalkylene oxide or derivatives thereof such as ethers, esters or amines, etc., thioether compounds, thiomorpholines, quaternary ammonium salt compounds, urethane derivatives, urea derivatives, imidazole derivatives, 3-pyrazolidones, etc., for the purpose of increasing sensitivity, increase of contrast or acceleration of development.

The photographic light-sensitive materials used in the present invention can contain in the photographic emulsion layers or other hydrophilic colloid layers a dispersion of a water-insoluble or poorly soluble synthetic polymer, for the purpose of improving dimensional stability.

The photographic emulsions used in the present invention may be spectrally sensitized with methine dyes or others. Examples of dyes used include cyanine dyes, merocyanine dyes, complex cyanine dyes, complex merocyanine dyes, holopolar cyanine dyes, hemicyanine dyes, styryl dyes and hemioxonol dyes. Particularly useful dyes are those belonging to cyanine dyes, merocyanine dyes and complex merocyanine dyes. In these dyes, any nuclei utilizing ordinarily for cyanine dyes as a basic heterocyclic nuclei can be used. For example, it is possible to utilize a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; nuclei wherein an alicyclic hydrocarbon ring is fused with the above described nuclei; nuclei wherein an aromatic hydrocarbon ring is fused with the above described nuclei, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc. These nuclei may be substituted on carbon atoms.

In merocyanine dyes or complex merocyanine dyes, 5-or 6-member heterocyclic nuclei such as a pyrazolin-5-one nucleus, a thiohydantoin nucleus, a 2-thioxazolidin-2,4-dione nucleus, a thiazolidin-2,4-dione nucleus, a rhodanine nucleus, a thiobarbituric acid nucleus, etc., can be utilized as nuclei having a ketomethylene structure.

These sensitizing dyes may be used alone, but they may be used in combination. A combination of sensitizing dyes is often used particularly for the purpose of supersensitization.

The emulsions may contain dyes which do not have a spectral sensitization function themselves or substances which do not substantially absorb visible light but show a supersensitization effect, together with the sensitizing dyes. For example, aminostyryl compounds substituted with a nitrogen containing heterocyclic group (for example, those described in U.S. Pat. Nos. 2,933,390 and 3,635,721), aromatic organic acid-formaldehyde condensation products (for example, those described in U.S. Pat. No. 3,743,510), cadmium salts, azaindene compounds, etc., may be incorporated.

The present invention can be applied to multilayer color photographic materials having at least two layers each having different spectral sensitivity on a base. Multilayer natural color photographic materials generally have at least a red-sensitive emulsion layer, a green-sensitive emulsion layer and a blue-sensitive emulsion layer on a base. The order of these layers can be arbitrarily selected as occasion demands.

In the photographic light-sensitive materials of the present invention, the photographic emulsion layers and other hydrophilic colloid layers may contain inorganic or organic hardeners. For example, chromium salts (chromium alum, chromium acetate, etc.), aldehydes (formaldehyde, glyoxal, glutaraldehyde, etc.), N-methylol compounds (dimethylolurea, methyloldimethylhydantoin, etc.), dioxane derivatives (2,3-dihydroxydioxane, etc.), active vinyl compounds (1,3,5-triacryloylhexahydro-S-triazine, 1,3-vinylsulfonyl-2-propanol, etc.), active halogen compounds (2,4-dichloro-6-hydroxy-S-triazine, etc.), mucohalogenic acids (mucochloric acid, mucophenoxychloric acid, etc.), etc., can be used alone or in combination.

In the light-sensitive materials produced according to the present invention, when dyes or ultraviolet ray absorbing agents are incorporated in hydrophilic colloid layers, they may be mordanted with cationic polymers, etc.

The light-sensitive materials produced according to the present invention may contain hydroquinone derivatives, aminophenol derivatives, gallic acid derivatives, ascorbic acid derivatives, etc., as color stain preventing agents.

In the light-sensitive materials produced according to the present invention, the hydrophilic colloid layers may contain ultraviolet ray absorbing agents. For example, it is possible to use benzotriazole compounds substituted by an aryl group (for example, those described in U.S. Pat. No. 3,533,794), 4-thiazolidone compounds (for example, those described in U.S. Pat. Nos. 3,314,794 and 3,352,681), benzophenone compounds (for example, those described in Japanese Patent Application (OPI) No. 2784/71), cinnamic acid ester compounds (for example, those described in U.S. Pat. Nos. 3,705,805 and 3,707,375), butadiene compounds (for example, those described in U.S. Pat. No. 4,045,229) and benzoxidol compounds (for example, those described in U.S. Pat. No. 3,700,455). Ultraviolet ray absorbing couplers (for example, α-naphthol type cyan dye forming couplers) or ultraviolet ray absorbing polymers may be used. These ultraviolet ray absorbing agents may be mordanted in a specific layer.

In the light-sensitive materials produced according to the present invention, the hydrophilic colloid layers may contain water soluble dyes as filter dyes or for the purpose of preventing irradiation or others. Examples of such dyes include oxonol dyes, hemioxonol dyes, styryl dyes, merocyanine dyes, cyanine dyes and azo dyes. Of these, oxonol dyes, hemioxonol dyes and merocyanine dyes are particularly useful.

In practicing the present invention, the following known antifading agents can be used together. Further, one or more dye image stabilizers can be used in the present invention. As the known antifading agents, there are hydroquinone derivatives, gallic acid derivatives, p-alkoxyphenols, p-oxyphenol derivatives and bisphenols.

In order to carry out photographic processing of layers composed of photographic emulsions prepared according to the present invention, any known processes and known processing solutions, as described in, for example, Research Disclosure Vol. 176, pages 28 to 30, can be utilized. Processing temperature is generally selected between 18° C. and 50° C. However, a temperature of lower than 18° C. or a temperature of higher than 50° C. may be used.

The color developing solution is generally composed of an alkaline aqueous solution containing a color developing agent. As the color developing agents, it is possible to use known primary aromatic amine developing agents, for example, phenylenediamines (for example, 4-amino-N,N-diethylaniline, 3-methyl-4-amino-N,N-diethylaniline, 4-amino-N-ethyl-N-62-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, etc.).

In addition, those described in L.F.A. Mason: Photographic Processing Chemistry (The Focal Press, 1966), pages 226 to 229, U.S. Pat. Nos. 2,193,015 and 2,592,364 and Japanese patent application (OPI) No. 64933/73 may be used.

The color developing solution can contain pH buffer agents such as sulfites, carbonates, borates and phosphates of alkali metals, and development restrainers or antifoggants such as bromides, iodides and organic antifoggants, etc. If necessary, it may contain water softeners, preservatives such as hydroxylamine, organic solvents such as benzyl alcohol or diethylene glycol, development accelerators such as polyethylene glycol or quaternary ammonium salts, dye forming couplers, competing couplers, fogging agents such as sodium borohydride, supplementary developing agents such as 1-phenyl-3-pyrazolidone, viscosity increasing agents, polycarboxylic acid type chelating agents, antioxidants, etc.

The photographic emulsion layers after color development are ordinarily subjected to bleach processing. The bleach processing may be carried out simultaneously with fixation processing or may be carried out separately. As bleaching agents, for example, compounds of polyvalent metals such as iron (III), cobalt (III), chromium (VI), copper (II), etc., peracids, quinones, nitroso compounds, etc., are used.

For example, it is possible to use ferricyanides, bichromic salts, organic complex salts of iron (III) or cobalt (III), for example, complex salts of aminopolycarboxylic acids such as ethylenediaminetetraacetic acid, nitrilotriacetic acid or 1,3-diamino-2-propanoltetraacetic acid, or organic acids such as citric acid, tartaric acid or malic acid; persulfates, permanganates; nitrosophenol, etc. Of these substances, potassium ferricyanide, sodium ethylenediaminetetraacetato iron (III) and ammonium ethylenediaminetetraacetato iron (III) are particularly useful. Ethylenediaminetetraacetato iron (III) complex salts are useful in both an independent bleaching solution and a one-bath bleach-fix solution.

As a fixing solution, that having a composition conventionally used can be used. As fixing agents, not only thiosulfates and thiocyanates but also organic sulfur compounds which are known to have a fixing effect can be used. The fixing solution may contain water soluble aluminium salts as a hardener.

In the following, synthesis processes for the coupler used in the present invention are illustrated.

SYNTHESIS EXAMPLE 1

Synthesis of illustrated coupler (1)

Into 40 ml of acetonitrile, 9.00 g of 6-amino-3-ethyl-2,4-dichlorophenol hydrochloride was dispersed and then 11.6 g of 2-(2,4-di-tert-butylphenoxy) propanoylchloride was added dropwise. After heat-reflux for 40 minutes, the reaction mixture was cooled and crystals thus deposited were recrystallized from acetonitrile to obtain 12.8 g of non-colored crystals (m.p. 186° to 187° C.)

| | C (%) | H (%) | N (%) |
|---|---|---|---|
| Elementary Analysis | 64.34 | 7.16 | 2.81 |
| calculated | 64.38 | 7.13 | 3.00 |

SYNTHESIS EXAMPLE 2

Synthesis of illustrated coupler (9)

Into a solvent mixture comprising 40 ml of acetonitrile and 8 ml of dimethylacetamide, 10.0 g of 6-amino-3-ethyl-2,4-dichlorophenol hydrochloride was dispersed, and 14.0% of 4-(2,4-di-tert-anylphenoxy) butanoylchloride was added dropwise under heat-refluxing. After undergoing reaction for 1 hour, the reaction mixture thus obtained was cooled and crystals thus deposited were recrystallized from acctonitrile to obtain 14.0 g of no-colored crystal (m.p. 173° to 174° C.)

| | C (%) | H (%) | N (%) |
|---|---|---|---|
| Elementary Analysis | 66.11 | 7.71 | 2.70 |
| calculated | 66.13 | 7.73 | 2.75 |

In the following, the present invention is illustrated in greater detail with reference to examples, but the present invention is not limited to them.

EXAMPLE 1

A solution prepared by heating 10 g of Coupler (1) of the present invention, 10 g of trioctyl phosphate and 20 ml of ethyl acetate to 50° C. was added to 100 ml of an aqueous solution containing 10 g of gelatin and 0.4 g of dodecylbenzenesulfonic acid with stirring. Then the mixture was previously heated and allowed to pass 5 times through a colloid mill to finely disperse the same by emulsification.

The entire emulsion was added to 400 g of a photographic emulsion containing 21 g of silver chlorobromide and 24 g of gelatin. After 30 ml of a 2% aqueous solution of 4,6-dichloro-4-hydroxytriazine was added as a hardener, the pH of the suspension was adjusted to 6.0 and the suspension was uniformly applied to a triacetyl cellulose type film base. This film is called Sample A.

Films were prepared by the same procedure as described above using Couplers (2), (4), (7) and (9) instead of Coupler (1). These films are called Samples B, C, D and E.

For comparison, films were prepared by the same procedure as described above using the same molan amount of Comparative Couplers (101) and (102) instead of Coupler (1). These films are called Samples F and G.

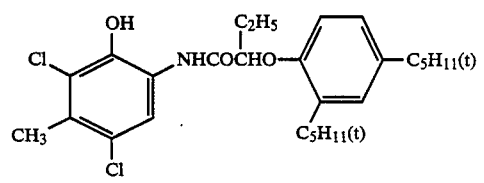

(101)

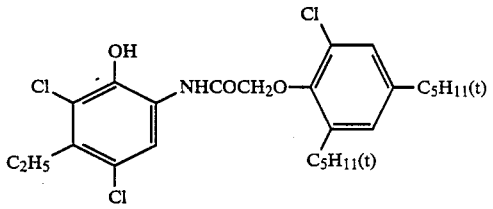

(102)

which are described in U.S. Pat. No. 3,722,002.

After each sample was exposed to light using a continuous wedge for sensitometry, it was subjected to the following development processing.

| Color development processing (33° C.) | |
|---|---|
| 1. Color development | 3 minutes and 30 seconds |
| 2. Bleach-fixation | 1 minute and 30 seconds |
| 3. Water wash | 2 minutes and 30 seconds |

The processing solution used in each step were as follows:

| | |
|---|---|
| Color developing solution: | |
| Benzyl alcohol | 15.0 ml |
| Diethylene glycol | 8.0 ml |
| Ethylenediaminetetraacetic acid | 5.0 g |
| Sodium sulfite | 2.0 g |
| Anhydrous potassium carbonate | 30 g |
| Hydroxylamine sulfate | 3.0 g |
| Potassium bromide | 0.6 g |
| 4-Amino-N—ethyl-N—β-methanesulfonamido-ethyl)-m-toluidine sesquisulfate monohydrate | 5.0 g |
| Water to make | 1 l (pH 10.2) |
| Bleach-fix solution: | |
| Ethylenediaminetetraacetic acid | 4.0 g |
| Ferric salt of ethylenediaminetetra-acetic acid | 40 g |
| Sodium sulfite | 5.0 g |
| Sodium thiosulfate (70%) | 150 ml |
| Water to make | 1 l |

Then, the fastness of each film after development was examined. The fastness in the case that the sample was allowed to stand at 100° C. for 6 days in the dark, the fastness in the case that the sample was allowed to stand at 60° C. under 70% RH for 6 weeks in the dark, and the fastness in the case that the sample was exposed to light for 6 days by a xenon tester (100,000 lux) are shown in Table 1 wherein the fastness is shown as a density reduction rate at an initial density of 1.0.

TABLE 1

| Film Sample | Coupler | 100° C. 6 days (%) | 70° C., 70% 6 weeks (%) | Light 6 days (%) |
|---|---|---|---|---|
| A | (1) (This invention) | 20 | 11 | 21 |
| B | (2) (This invention) | 19 | 12 | 22 |
| C | (4) (This invention) | 20 | 11 | 21 |
| D | (7) (This invention) | 22 | 12 | 26 |
| E | (9) (This invention) | 23 | 13 | 20 |
| F | (101) (Comparison) | 62 | 25 | 26 |
| G | (102) (Comparison) | 25 | 15 | 37 |

It is understood from Table 1 that dyes formed using couplers of the present invention have excellent fastness.

EXAMPLE 2

The 1st layer (the lowest layer)–the 7th layer (top layer) were applied to a polyethylene laminated paper as shown in Table 2 and Table 3 to produce multilayer color photographic light-sensitive films (Samples H–L). (In the table, mg/m$^2$ means coating amount.)

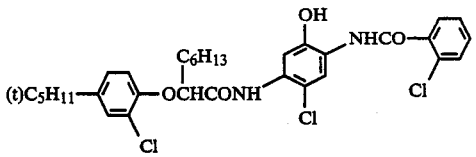

(103)

TABLE 2

| Sample | Cyan Coupler | Note |
|---|---|---|
| H | (1) | (This invention) |
| I | (4) | (This invention) |
| J | (1)/(103) (molar ratio: 1:1) | (This invention) |
| K | (101) | (Comparative example) |
| L | (102) | (Comparative example) |

TABLE 3

| | | |
|---|---|---|
| The 7th layer (Protective layer) | Gelatin | 1000 mg/m$^2$ |
| The 6th layer (Ultraviolet ray absorbing layer) | Ultraviolet ray absorbing agent (*1) | 600 mg/m$^2$ |
| | Solvent for ultraviolet ray absorbing agent (*2) | 300 mg/m$^2$ |
| | gelatin | 800 mg/m$^2$ |
| The 5th layer (Red-sensitive layer) | Silver chlorobromide emulsion (silver bromide 50% by mol) | silver 3300 mg/m$^2$ |
| | Cyan coupler (described in Table 2) | 0.8 m mol/m$^2$ |
| | Solvent for coupler (*2) | 400 mg/m$^2$ |
| | Gelatin | 1000 mg/m$^2$ |
| The 4th layer (Intermediate layer) | Ultraviolet ray absorbing agent (*1) | 600 mg/m$^2$ |
| | Solvent for ultraviolet ray absorbing agent (*2) | 300 mg/m$^2$ |
| | Gelatin | 800 mg/m$^2$ |
| The 3rd layer (Green-sensitive layer) | Silver chlorobromide emulsion (silver bromide 70% by mol) | silver 300 mg/m$^2$ |
| | Magenta coupler (*3) | 200 mg/m$^2$ |
| | Solvent for coupler (*4) | 200 mg/m$^2$ |
| | Gelatin | 1000 mg/m$^2$ |
| The 2nd layer (Intermediate layer) | Gelatin | 1000 mg/m$^2$ |
| The 1st layer (Blue-sensitive layer) | Silver chlorobromide emulsion (silver bromide 80% by mol) | 400 mg/m$^2$ |
| | Yellow coupler (*5) | 300 mg/m$^2$ |
| | Solvent for coupler (*6) | 150 mg/m$^2$ |
| | Gelatin | 1200 mg/m$^2$ |
| Base | Paper support wherein the both sides are laminated with polyethylene. | |

(*1) Ultraviolet ray absorbing agent: 2-(2-Hydroxy-3-sec-butyl-5-tert-butylphenyl)-benzotriazole.
(*2) Solvent: Dibutyl phthalate
(*3) Coupler: 1-(2,4,6-Trichlorophenyl)-3-(2-chloro-5-tetradecanamide)anilino-2-pyrazolin-5-one
(*4) Solvent: Tricresyl phosphate
(*5) Coupler: α-Pivaloyl-α-(2,4-dioxy-5,5'-dimethyl-oxazolidin-3-yl)-2-chloro-5-[α-(2,4-di-tert-pentyloxy)butanamide]acetanilide
(*6) Solvent: Dioctylbutyl phosphate After these Samples H–L were subjected to gray exposure through an optical wedge by an enlarger: Fuji Color head 690 (produced by Fuji Photo Film Co.), they were processed as follows.

| Processing step (33° C.) | Processing Time |
|---|---|
| Color development | 3'30" |
| Bleach-fixation | 3'30" |
| Water wash | 3'30" |
| Drying | |

| Color developing solution: | |
|---|---|
| Benzoyl alcohol | 15 ml |
| Diethylene glycol | 10 ml |
| Potassium carbonate | 30 g |
| Potassium bromide | 0.5 g |
| Sodium hydrogen carbonate | 0.8 g |
| Sodium sulfite | 2 g |
| Hydroxylamine sulfate | 3 g |
| N—Ethyl-N—β-methanesulfonamidoethyl-3-methyl-4-aminoaniline sulfate | 4.5 g |

Water was added to make 1 l, and the pH was adjusted to 10.2 with sodium hydroxide.

| Bleach-fix solution (A): | |
|---|---|
| Ammonium thiosulfate | 120 g |
| Sodium sulfite | 12 g |
| Sodium hydrogen sulfite | 2 g |
| EDTA ferric ammonium salt | 40 g |
| EDTA 2 sodium salt | 4 g |

Water was added to make 1 l, and pH was adjusted to 7.0 with sodium carbonate.

Bleach-fix solution (B):

The solution was prepared by adding 300 ml of the above described color developing solution to the composition of the bleach-fix solution (A).

Bleach-fix solution (C):

The fatigued solution was obtained by continuously processing Fuji Color Paper (produced by Fuji Photo Film Co.) with an automatic developing apparatus for color paper until it became a constant state.

The values of maximum density ($D^R$ max) of the processed samples measured by a Macbeth densitometer Status AA Filter are shown in Table 4.

TABLE 4

| Sample | In the case of using bleach-fix solution (A) $D^R$ max | In the case of using bleach-fix solution (B) $D^R$ max | In the case of using bleach-fix solution (C) $D^R$ max | Note |
|---|---|---|---|---|
| H | 2.97 | 2.92 | 2.91 | This invention |
| I | 2.98 | 2.91 | 2.90 | This invention |
| J | 2.96 | 2.94 | 2.93 | This invention |
| K | 2.96 | 2.80 | 2.72 | Comparative example |
| L | 2.98 | 2.85 | 2.76 | Comparative example |

As be understood from Table 4, the lowering of the density of the cyan dye in the case of processing with the fatigued bleach-fix solution is great in the comparative examples as compared with samples of the present invention.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material containing a cyan dye forming coupler represented by the following general formula (I):

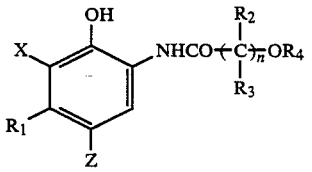

(I)

wherein $R_1$ represents an alkyl group having 2 to 15 carbon atoms, $R_2$ and $R_3$ each represent a hydrogen atom or an alkyl group, $R_4$ represents a substituted aryl group which is substituted by a group other than an aryl group or an aralkyl group, wherein said group other than an aryl group or an aralkyl group can be at least one alkyl group, X represents a chlorine atom or a fluorine atom, Z represents a chlorine atom or a fluorine atom, n represents an integer of 1 to 4, and the total number of carbon atoms in the alkyl groups contained in $R_1$, $R_2$, $R_3$, and $R_4$ is 8 or more, and the total number of carbon atoms in the alkyl groups contained in $R_1$ and $R_4$, in the case that n is 1, is 11 or less.

2. The silver halide color photographic light-sensitive material as claimed in claim 1, wherein $R_1$ is selected from the group consisting of an ethyl group, a butyl group, a tert-butyl group, a cyclohexyl group or a pentadecyl group.

3. The silver halide color photographic light-sensitive material as claimed in claim 1, wherein $R_2$ and $R_3$ are an alkyl group having from 1 to 21 carbon atoms.

4. The silver halide color photographic light-sensitive material as claimed in claim 1, wherein $R_1$ is a straight chain, branched chain or cyclic alkyl group having from 2 to 6 carbon atoms.

5. The silver halide color photographic light-sensitive material as claimed in claim 1, wherein $R_2$ is a hydrogen atom and $R_3$ is an alkyl group having from 1 to 21 carbon atoms.

6. The silver halide color photographic light-sensitive material as claimed in claim 1, wherein $R_1$ represents an alkyl group having 2 to 6 carbon atoms, $R_2$ and $R_3$ each represent a hydrogen atom or an alkyl group having from 1 to 12 carbon atoms and $R_4$ is a substituted phenyl or naphthyl group.

7. The silver halide color photographic light-sensitive material as claimed in claim 1, wherein X and Z are both a chlorine atom.

8. The silver halide color photographic light-sensitive material as claimed in claim 7, wherein $R_4$ is substituted with two substituents and they are both alkyl groups.

9. The silver halide color photographic light-sensitive material as claimed in claim 7, wherein $R_4$ is substituted with two substituents, one of which is an alkyl group and one of which is a halogen atom.

10. The silver halide color photographic light-sensitive material as claimed in claim 1, wherein the compound represented by general formula (I) is employed in an amount of from $1\times10^{-3}$ mol to $7\times10^{-1}$ mol per mol of silver in the emulsion layer.

11. The silver halide color photographic light-sensitive material as claimed in claim 2, wherein the compound represented by general formula (I) is employed in an amount of from $1\times10^{-2}$ mol to $5\times10^{-1}$ mol per mol of silver in the emulsion layer.

* * * * *